US006779339B1

(12) United States Patent
Laroo et al.

(10) Patent No.: US 6,779,339 B1
(45) Date of Patent: Aug. 24, 2004

(54) METHOD FOR $NO_X$ ADSORBER DESULFATION IN A MULTI-PATH EXHAUST SYSTEM

(75) Inventors: Christopher A. Laroo, Canton, MI (US); Charles R. Schenk, Ypsilanti, MI (US); Joseph F. McDonald, Ann Arbor, MI (US); Byron J. Bunker, Ann Arbor, MI (US); Brian A. Olson, Jackson, MI (US); Robert E. Moss, Belleville, MI (US); Daniel C. Stokes, Ann Arbor, MI (US); Paul Anthony Way, Canton, MI (US)

(73) Assignee: The United States of America as represented by the Environmental Protection Agency, Washington, DC (US)

( * ) Notice: Subject to any disclaimer, the term of this patent is extended or adjusted under 35 U.S.C. 154(b) by 0 days.

(21) Appl. No.: 10/428,153

(22) Filed: May 2, 2003

(51) Int. Cl.[7] ..... F01N 3/00

(52) U.S. Cl. ..... 60/297; 60/274; 60/286; 60/287; 60/291; 60/292; 60/295; 60/303

(58) Field of Search ..... 60/274, 286, 287, 60/288, 290, 291, 295, 297, 303, 305

(56) References Cited

U.S. PATENT DOCUMENTS 5,388,406 A * 2/1995 Takeshima et al. ..... 60/297
5,402,641 A 4/1995 Katoh et al. ..... 60/285
5,715,677 A * 2/1998 Wallman et al. ..... 60/274
5,758,493 A 6/1998 Asik ..... 60/274
5,853,459 A * 12/1998 Kuwamoto et al. ..... 95/273
5,974,791 A * 11/1999 Hirota et al. ..... 60/276
5,983,627 A 11/1999 Asik ..... 60/274
6,058,700 A 5/2000 Yamashita et al. ..... 60/285
6,119,450 A 9/2000 Boegner et al. ..... 60/274
6,164,064 A 12/2000 Pott ..... 60/277
6,167,696 B1 1/2001 Maaseidvaag et al. ..... 60/274
6,293,094 B1 9/2001 Schmidt et al. ..... 60/284
6,318,073 B1 11/2001 Boegner et al. ..... 60/274
6,708,486 B2 * 3/2004 Hirota et al. ..... 60/297

* cited by examiner

*Primary Examiner*—Binh Q. Tran
(74) *Attorney, Agent, or Firm*—Lorusso, Loud & Kelly; George A. Loud

(57) ABSTRACT

The method of treating a fuel lean exhaust containing $NO_X$ and $SO_2$ includes splitting the exhaust into major and minor portions for flow through multiple flow paths each of which contains a particulate trap and an absorber containing a $NO_X$ oxidation catalyst and a nitrate absorbent. The major portion is passed through a flow path in the lean state at a first temperature to convert the $NO_X$ to nitrate and the $SO_2$ to sulfate. After the first period of operation flows are switched so that one flow path receives a minor exhaust portion for a second period of time during which fuel is injected into that flow path along with diversion of a portion of exhaust from another flow path through a bypass. When during the second period of operation the particulate trap reaches a predetermined temperature, the flow path is opened to an increased exhaust flow to transfer heat from the particulate trap to the $NO_X$ absorber to bring the $NO_X$ absorber to a temperature suitable for sulfation, at which time fuel and a small portion of exhaust gas are again introduced in order to effect the desulfation.

12 Claims, 1 Drawing Sheet

METHOD FOR $NO_X$ ADSORBER DESULFATION IN A MULTI-PATH EXHAUST SYSTEM

FIELD OF THE INVENTION

This method provides a technique for on-vehicle $NO_X$ adsorber desulfation especially for use in $NO_X$ adsorber catalyst equipped diesel vehicles employing a multi-leg exhaust flow path.

THE PRIOR ART

New emission reduction standards for lean burn heavy-duty diesel engines are to be implemented starting in model year 2007. The new standards will require catalysts and systems that can suppress the emission of oxides of nitrogen ($NO_X$) from these engines into the atmosphere. Current $NO_X$ adsorber catalyst formulations typically contain a combination of one or more of the following substances: alkali metals such as potassium (K), sodium (Na), lithium (Li) and cesium (Cs); alkali earth metals such as barium (Ba) and calcium (Ca); rare earth metals such as lanthanum (La) and yttrium (Y); and precious metals such as platinum (Pt) and rhodium (Rh). The precious metals in the catalyst wash coat oxidize NO and $NO_2$ to nitrate ion ($NO_3^-$) and the nitrate ion is subsequently absorbed by the $NO_X$ adsorbent (alkali metals, alkali earth metals and rare earth metals) to form stable nitrates. These nitrate ions are then desorbed in a rich exhaust environment (lambda<<1) at normal engine operating temperatures and reduced over precious metal sites to diatomic nitrogen.

It has been found in development testing that the $NO_X$ storage and reduction capacity of the adsorber decreases over time. The main mechanisms responsible for the decrease in adsorber $NO_X$ storage and reduction capacity are thermal degradation of the adsorber wash coat and poisoning due to the presence of sulfur in diesel fuel. The sulfur is first oxidized during combustion, forming $SO_2$. The $SO_2$ is then further oxidized to $SO_3$ and sulfate ion ($SO_4^{2-}$) via the reaction with $O_2^-$ or $O^{2-}$on the surface of the platinum in the adsorber wash coat. The sulfate ion is then adsorbed by the $NO_X$ adsorbent (alkali metals, alkali earth metals, and rare earth metals) to form stable sulfates (for example $BaSO_4$), reducing the number of sites available for $NO_X$ adsorption. These sulfates have a higher binding affinity for alkali/alkali-earth/rare earth metals than nitrates, thus requiring temperatures that are much higher than those present in typical diesel exhaust to be desorbed. Higher temperatures, in conjunction with a rich exhaust environment (lambda<<1) are required to remove the sulfate ion from the $NO_X$ adsorbent. The process of removal of sulfates from $NO_X$ adsorbers will be referred to herein as desulfation.

SUMMARY OF THE INVENTION

The present invention provides a method and apparatus for desulfating $NO_X$ adsorber catalysts in a multi exhaust path flow system utilizing in-exhaust fuel injection and exhaust flow bypass. This method minimizes temperature extremes on the surface of the $NO_X$ adsorber, while achieving the precise temperatures required for desulfation. Thus, overall thermal degradation of the adsorber catalyst due to high temperatures is kept to a minimum or ultimately eliminated. This method allows the sulfates to desorb from the adsorber catalyst, as $H_2S$ and $SO_2$, at exhaust lambda values <1.

The present invention generates an exotherm on particulates accumulated in a trap upstream of a $NO_X$ adsorber, convectively transfers heat to the $NO_X$ adsorber, and minimizes local temperature extremes on the surface of the $NO_X$ adsorber. This, in turn, reduces the chances for thermal damage, e.g., deactivation of the adsorber $NO_X$ storage and reduction function due to sintering and migration of the wash coat into the catalyst substrate (i.e., migration of alkali, alkali earth, and rare earth metals). The present invention also allows better control over the desulfation and does not affect the drivability of the vehicle, as has been reported in connection with single leg systems.

More specifically, the present invention splits an exhaust stream into two or more paths or legs, each leg of the system containing of a $NO_X$ adsorber and a particulate trap, preferably a catalyzed diesel particulate filter (hereinafter "CDPF"), upstream of the $NO_X$ adsorber. While desulfating one of the multiple flow paths, the desulfating path is bypassed so that only a very small fraction of the exhaust flows through the desulfating $NO_X$ adsorber. This flow is due to incomplete sealing of the exhaust brake used to shut flow off to the bypassed leg. The incorporation of the perpendicular exhaust bypass loop allows controlled addition of exhaust from the adsorbing leg to the desulfation leg. This addition of exhaust allows for control over the mass of oxygen in the desulfating leg. Reductant is added via secondary fuel injection directly into the desulfating leg, upstream of the CDPF. The oxygen causes an exothermic oxidation of the reductant across the CDPF. The extent of the exotherm is determined by the lambda value in the desulfating leg, which is a product of the amount of reductant and oxygen present in the leg. Lambda can also be defined as the ratio of actual oxygen concentration to the oxygen concentration required for stoichiometry. The exotherm causes a rise in the CDPF temperature which is monitored. In pilot plant experimentation the CDPF temperature was measured by six thermocouples inserted along the CDPF horizontally. The heat is convectively transferred from the CDPF to the $NO_X$ adsorber catalysts by manipulation of the exhaust bypass flow rate from the adsorbing leg to the desulfating leg. Heat transfer can also occur without using the perpendicular exhaust bypass loop by momentarily opening the desulfating leg to full exhaust flow and then closing off the flow once the heat has transferred. Once the adsorber is heated to the desired temperature, reductant is added to facilitate sulfur release. The perpendicular exhaust bypass loop flow is controlled to maintain an exotherm across the CDPF and to allow heat transfer from the CDPF to the $NO_X$ adsorber to maintain the desired desulfation temperature.

Accordingly, the present invention provides a method for treating an exhaust gas stream which is in a lean state, fuel-lean of stoichiometric, and which contains $NO_X$ and $SO_2$. The method includes splitting the exhaust gas stream into major and minor exhaust gas portions for flow through at least first and second separate flow paths, each of the flow paths containing a particulate trap and, downstream of the particulate trap, a $NO_X$ adsorber containing a $NO_X$ oxidation catalyst and a nitrate adsorbent. The major portion of the exhaust gas is passed in the lean state, for a first period of operation, along at least one of the flow paths and through, in succession, the particulate trap and the $NO_X$ adsorber to convert $NO_X$ to nitrate, to convert the $SO_2$ to sulfate and to adsorb the nitrate and the sulfate on the nitrate adsorbent. Temperatures in the particulate trap and the $NO_X$ adsorber are monitored. After the first period of operation, the flows of the exhaust gas portions are switched so that the one flow path receives the minor exhaust gas portion for a second period of time and, during at least a part of the second period of time, fuel is introduced into the one flow path, upstream of the particulate trap, for combustion in the particulate trap to produce a fuel-rich, reducing exhaust flow. During that same second period of operation, a bypass portion of the exhaust gas is diverted from another flow path at a point upstream of the particulate trap and is introduced into the one flow path also upstream of its particulate trap. When the temperature of the particulate trap in the one flow path reaches a first predetermined temperature, heat of fuel thereto is discontinued and exhaust gas flow is increased to transfer heat from the particulate trap to the $NO_X$ adsorber, to raise the temperature of the $NO_X$ adsorber to a second predetermined temperature for desulfation. The major and minor exhaust gas portions are periodically switched between flow paths so that a second period of operation is effected in one flow path while a first period of operation is effected in at least one other flow path.

Engine speed and/or engine load may be monitored and the amount of fuel introduced and bypass flow exhaust introduced, during the second period of time, may be set in accordance with the determined engine speed and/or engine load.

The method of the present invention may further include sensing the $NO_X$ concentration exiting each $NO_X$ adsorber and, responsive to that sensed concentration exceeding a predetermined value, switching the flows of exhaust gas portions so that a flow path to be subjected to denitration receives the minor exhaust gas portion. Fuel is then introduced into the minor exhaust gas portion to create a reducing atmosphere for reduction of nitrates adsorbed on the nitrate adsorbent, to form molecular nitrogen gas.

The present invention is also embodied in an apparatus for treating an exhaust gas stream having the aforementioned characteristics. The apparatus includes plural exhaust flow conduits for respectively receiving portions of exhaust gas from an internal combustion engine. Each exhaust gas conduit includes a particulate trap and, downstream of the particulate trap, a $NO_X$ adsorber containing a $NO_X$ oxidation catalyst. The apparatus further includes temperature sensors for monitoring temperatures of the particulate traps and the $NO_X$ adsorbers. A bypass line connects each exhaust flow conduit with at least one other exhaust flow conduit, at points upstream of the particulate traps. A regulating valve is provided in the bypass line and a fuel injector is provided in each of the exhaust flow conduits, upstream of the particulate trap. A controller controls the regulating valve and the fuel injector for an exhaust flow path for desulfation, responsive to the sensed temperatures and engine speed and/or engine load.

DESCRIPTION OF THE PREFERRED EMBODIMENTS

Figure 1:
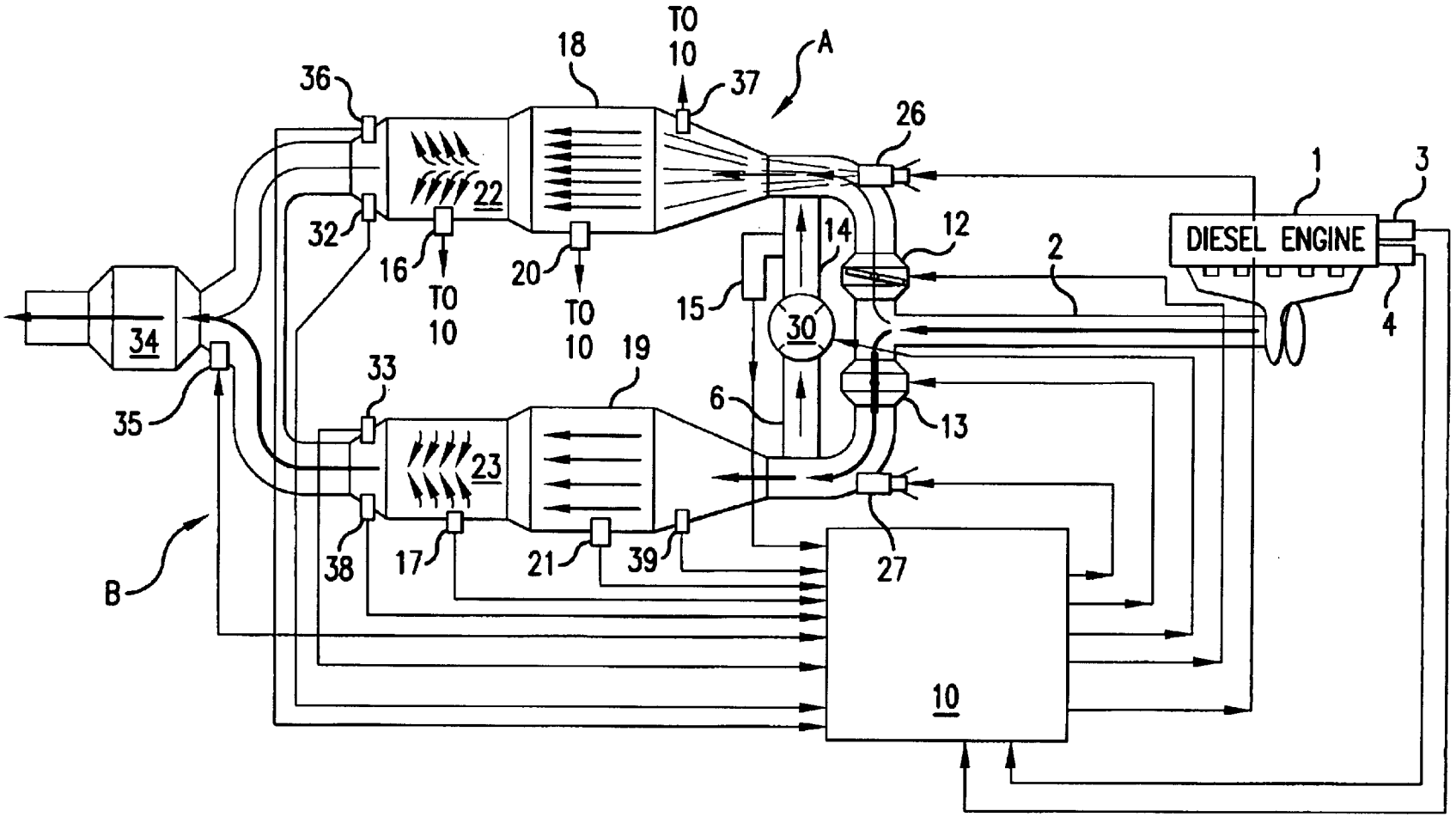
FIG. 1 is a schematic diagram of a vehicle on-board exhaust treatment system in accordance with a preferred embodiment of the present invention.

FIG. 1 illustrates one preferred embodiment of the present invention. In terms of apparatus the individual components are conventional, except for the bypass 6, the bypass control valve 30 and the means 10 for controlling same, and are readily available. The apparatus of the preferred embodiment depicted in FIG. 1 includes that previously described in SAE 2001-01-3619 with addition of a perpendicular exhaust bypass loop 6 that connects both of the exhaust paths "A" and "B" upstream of the CDPFs 18, 19, a bypass control valve 30 and control means therefor. This bypass is a conduit 6 which consists of a one-inch stainless steel tube outfitted with an EGR valve 30 to control bypass flow. Bypass flow was measured through the use of an orifice 14 and pressure transducers 15. The valving is controlled by a National Instruments, Inc. data acquisition and control system, i.e., controller 10 in FIG. 1.

As further shown in FIG. 1, diesel engine 1 generates an exhaust flow 2 which is spit into flow paths "A" and "B" with flow therethrough governed by open/close control valves 12, 13. Diesel engine 1 is provided with an engine speed sensor 3 and an engine load sensor 4. The split exhaust flow paths "A", "B", each contain a catalytic diesel particulate filter (CDPF) 18, 19 and an $NO_X$ adsorber 22, 23. The exhaust gas streams exiting the $NO_X$ adsorbers 22, 23 are recombined and passed through a common diesel oxidation catalytic converter (DOC) 34. In this preferred embodiment as developed by experiment, the system is equipped with seven NGK zirconia oxide ($Zro_2$) oxygen/$NO_X$ sensors. These sensors output signals for both $NO_X$ and lambda ($\lambda$). Sensors 35, 36, 37, 38 and 39 are utilized as $NO_X$ sensors and sensors 32 and 33 are utilized as lambda sensors. A flow sensor, in the form of orifice 14 in combination with pressure transducers 15, is placed in the exhaust flow line 6. Additionally, $NO_X$ adsorbers 22 and 23 are each provided with a temperature sensor 16, 17 and the CDPFs 18, 19 are respectively provided with temperature sensors 20, 21. The controller 10 receives signals from all of the aforementioned sensors and, based on the received signals, in the manner described below controls the secondary fuel injectors, 26, 27, the exhaust-flow open/shut control valves 12, 13 and the exhaust bypass flow control valve 30.

The method of the present invention, in one departure from the prior art, uses no external heating source to achieve the high adsorber catalyst temperatures needed to initiate sustainable desulfation. Local temperature extremes are minimized on the $NO_X$ adsorber surface by generating the exotherm across the CDPF and then transferring the heat to the adsorber via exhaust flow. If the exotherm were to be generated across the $NO_X$ adsorber, hot spots would locally destroy the catalytic and adsorption functions. The operations constituting the method of the present invention may be summarized as follows:

A. At all times at least half of the exhaust system (one or more exhaust paths or "legs") is operating with a majority of the exhaust flow ("major portion") in an "adsorption mode", wherein the exhaust is well fuel-lean of stoichiometric, and $NO_X$ is adsorbed as a metallic nitrate (usually, but not limited to, barium or potassium nitrate) within the $NO_X$ adsorbent material.

B. Simultaneously with A, operating at least one of the exhaust paths in a denitration mode by restricting exhaust flow therethrough to small fraction (<5%), and injecting fuel into the exhaust path to make the exhaust fuel rich and thereby reduce the adsorbed nitrates to gaseous (molecular) nitrogen which exits the system. The denitration mode is described in more detail in SAE 2001-01-3619 (coauthored by Charles Schenk, Joseph McDonald and Chris Laroo) the teachings of which are incorporated herein by reference.

C. Responsive to detection of $NO_X$ leakage (typically, a concentration exceeding about 10 to 40 ppm) at the exit of a $NO_3$ absorber in an exhaust path operating in an adsorption mode, switching that exhaust path to the denitration mode. Typically, a given exhaust path will be switched between the $NO_X$ adsorption mode and the denitration mode about every 30 seconds–7 minutes. The fuel injection for denitration is typically effected within 2–3 seconds and denitration continues for 20 seconds to 7 minutes. The remainder of the time an exhaust path is in the denitration mode, if any, it simply sits idle with minimal exhaust gas flow therethrough. The denitration period will vary depending on the nature of the catalyst and adsorbent, the $NO_X$ concentration in the exhaust gas and the engine speed and/or load.

D. For desulfation, periodically and simultaneously with $NO_X$ adsorption in at least one other exhaust path, at least one path of the exhaust system has its exhaust flow restricted to only a small fraction (<5%) of the total flow and is operated in a desulfation mode. The desulfation of the $NO_X$ adsorber in each flow path is initiated periodically once per every 50 to 100 hours of operation, automatically, based on a threshold of loss in the $NO_X$ storage capacity.

E. While exhaust flow is restricted for desulfation, fuel is sprayed into the desulfating exhaust flow over the CDPF and the perpendicular bypass valve is opened for the first portion of the desulfation to use the CDPF to oxidize the fuel to CO and $CO_2$ and to generate a heat release over the CDPF due to the exothermic nature of the reaction. The injection of fuel and introduction of bypass exhaust are continued until the CDPF reaches a first predetermined temperature at which time the flow of fuel and bypass exhaust are discontinued. The amounts of fuel flow and bypass exhaust flow are set for in a given type of catalyst and adsorbent in accordance with a detected engine load and/or detected engine speed. The fuel flow might typically be about 2.5 lbs/min and continued (along with bypass exhaust flow) for up to 10 minutes.

F. Next, when the CDPF in the exhaust gas path undergoing desulfation reaches the first predetermined temperature, heat is transferred from the CDPF to the $NO_X$ adsorber, bringing the $NO_X$ adsorber catalysts up to the desired desulfating temperature (second predetermined temperature) for that specific catalyst formulation, i.e., to a second predetermined temperature, higher than the $NO_X$ adsorption temperature, and within a range of 500–750° C. This is done by using either the bypass valve to allow a controlled exhaust flow into the desulfating leg or by opening the desulfating leg so that the full engine exhaust flow travels through the desulfating leg. Another predetermined temperature set point is used to shut off the bypass or full flow to the desulfating leg, which temperature is based on the cooling effect of the bypass or full exhaust flow on the CDPF. When the CDPF has cooled to a third predetermined temperature or when the $NO_X$ adsorber temperature has risen to the second predetermined temperature, whichever occurs first, the exhaust flow is closed. If the $NO_X$ adsorber has reached the desired desulfation temperature, the controller proceeds to step G below. If the adsorber had not reached the target desulfation temperature (second predetermined temperature), steps D, E and F are repeated.

G. The desulfating leg is closed to exhaust flow when the desired desulfating temperature ("second predetermined temperature") is reached in the $NO_X$ adsorber. Fuel is then sprayed into a desulfating exhaust flow into the CDPF, the desulfating exhaust flow again being <5% of the total exhaust flow. Fuel injection is controlled to maintain a desired lambda value as monitored by $\lambda/NO_X$ sensors. Fuel injected at high temperatures causes sulfur to be released from the $NO_X$ adsorbers as $H_2S$ and $SO_2$. Release of these species has been confirmed using a chemical ionization mass spectrometer. If the adsorber catalyst's temperature decreases below optimal desulfating temperatures during sulfur release, the desulfating leg is again contacted with engine exhaust flow to initiate an exotherm across the CDPF and heat is then again convectively transferred to the adsorber to maintain the adsorber temperature.

It is important to note that the injection and bypass timing schedule as outlined above is dependent upon catalyst formulation, engine speed, engine load, and initial exhaust and catalyst temperature. Changes to the duration of each event in the sequence need to be made depending on the system conditions. Regardless of the event length, the overall technique used to perform the desulfation remains the same.

TEST PROCEDURES

Engine Description

The engine used for desulfation testing was a modified 5.9 liter displacement Cummins ISB. The engine modifications are identical to those previously described in SAE 2001-01-3619. The major engine specifications are summarized in Table 1.

TABLE 1

Summary of major engine specifications

| | |
|---|---|
| Engine: | 1999 Cummins ISB |
| Engine Configuration: | 6-cylinder, turbocharged-aftercooled, D1 diesel with 4-valves/cylinder |
| Rated Power: | 194 kW (260 bhp) @ 2500 rpm |
| Peak Torque: | 895 N-m (660 ft-lb) @ 1600 rpm |
| Fuel System: | Bosch HPCR |
| Engine Management: | Bosch/ETAS |
| EGR System: | High pressure loop, intake venturi w/throttled by-pass |
| Bore × Stroke: | 102 mm × 120 mm |
| Cylinder Displacement: | 5.88 L |
| Compression Ratio: | 16.3:1 |

Exhaust System Description

The dual path $NO_X$ adsorber system, specifications of the CDPFs and $NO_X$ adsorbers used with the system, and regeneration/$NO_X$ reduction control strategies used for this testing are similar to those previously described in detail in SAE 2001-01-3619. The entire system was built using readily obtainable components. CDPF and $NO_X$ adsorber volumes were not optimized. All control system components, including exhaust brakes, exhaust fuel injectors, wide-range linear UEGO sensors, and zirconia-$NO_X$ sensors remained the same as in the configuration described in SAE 2001-01-1351 (C. Schenck, J. McDonald and B. Olson), the teachings of which are incorporated herein by reference.

Modifications were made to the existing system for the purpose of sulfur removal from the catalyst. Modifications to the previously described system (SAE 2001-01-3619) include addition of an exhaust bypass pathway located downstream of the secondary fuel injectors and upstream of the CDPFs 18,19. These modifications are described in more detail in SAE 2002-01-2871, the teachings of which are incorporated herein by reference. The bypass was constructed of one inch inner diameter stainless steel tubing. The flow through the bypass path was controlled using a Lucas EGR valve, 30. Bypass flow was measured by determining the pressure difference across a sharp edge orifice 14. Thermocouples 16, 17 were inserted into the $NO_X$ adsorbers 22, 23 perpendicular to the flow path, at the mid-bed point of the substrate, for the purpose of monitoring the catalyst bed temperature. The CDPF substrate temperature was also monitored using two triple junction thermocouples 20, 21.

These thermocouples 20, 21 were inserted along the substrate horizontal at center and 5.25 inches radially from the center point of the flow path. The temperature measurement points of the junctions were located 2, 4, and 9 inches from the back of the CDPF at the center position and 1, 6, and 11 inches from the back of the CDPF at the radial position.

Test Cycles

All desulfation testing was done at mode 3 of the supplemental emissions test (SET), as described in SAE 2002-01-2871, at 1947 rpm and 328 lb-ft of torque. The engine out exhaust temperature at this mode was 450° C.

Test Fuel

The fuel used to poison the $NO_X$ adsorbers used for desulfation testing was Phillips Chemical Company Lot OEPULDO1. This fuel was specified by the U.S. Department of Energy's Diesel Emission Control-Sulfur Effects (DECSE) program to have similar properties to today's on-highway fuel with the exception of very low sulfur content. The fuel properties are shown in Table 2. A very low sulfur fuel was chosen to minimize the impact of sulfur poisoning on $NO_X$ adsorber.

The fuel used during desulfation testing was Phillips Chemical Company Lot 1 HPULDO1. This fuel was identical to that specified by the U.S. Department of Energy's Diesel Emission Control-Sulfur Effects (DECSE) program to have similar properties to today's on-highway fuel with the exception of zero sulfur content. The fuel properties are shown in Table 3. Lab results indicated a fuel sulfur concentration of less than 0.7 ppm by weight, which was below the limit of detection (LOD) for the instrument. Zero sulfur fuel was used in order to ensure that further poisoning of the $NO_X$ adsorbers did not occur during desulfation testing. Although trace amounts of sulfur were present in the fuel, it accounted for less than 28 ppb $SO_2$ engine out and its contribution to adsorber poisoning, as well as that from engine oil consumption, can be considered negligible.

Laboratory

The engine was tested at Heavy-Duty Engine (HDE) Site 2 at the U.S. EPA-NVFEL facility in Ann Arbor, Mich. The test site is equipped with a 600 bhp DC dynamometer and a Horiba full-flow CVS and particulate measurement system. Dilute gaseous regulated emissions were measured per 40 CFR § 86 Subpart N. Gaseous analyses were performed using a gas-analysis bench made up of loose analyzers previously described in SAE Tech. Paper Ser. 2001, No. 2001-01-3619. Modal measurement of sulfur released in the form of sulfur dioxide ($SO_2$) and hydrogen sulfide ($H_2S$) was performed using a V&F AS-2000 chemical ionization mass spectrometer utilizing internal high speed switching. Sulfur release was measured in between the $NO_X$ adsorbers and downstream of the second adsorber substrate in one leg of the dual path system. High speed sample switching allows measurements to take place in the exhaust at two points with a total cycle time of 1.5 seconds with a $T_{90}$ of less than 50 ms.

TABLE 2

Summary of low sulfur fuel properties

| Test Method | Results |
|---|---|
| Net Heat of Combustion, ASTM D3338-92 (MJIkg) | 43.19 |
| Density @ 15.5° C. (g/cm$^3$) | 0.8258 |

TABLE 2-continued

Summary of low sulfur fuel properties

| Test Method | Results |
|---|---|
| Cetane Number | 43.4 |
| Cetane Index | 53.5 |
| Olefins, FIA D1319-93 (% Vol.) | 3.3 |
| Aromatics, D1319-93 (% Vol.) | 24.2 |
| Sulfur, ASTM D2622 (ppm mass) | 3 |
| Carbon, ASTM D3343-95 (% mass) | 0.8638 |
| Distillation Properties, ASTM D86 | |
| IBP (° C.): | 191 |
| 10% (° C.): | 213 |
| 50% (° C.): | 258 |
| 90% (° C.): | 312 |
| End Point (° C.): | 346 |
| Residue Diesel (mL): | 0 |
| Recovery: | 100% |

TABLE 3

Summary of zero sulfur fuel properties.

| Test Method | Results |
|---|---|
| Net Heat of Combustion, ASIM D3338-92 (MJIkg) | 43.06 |
| Density @ 15.5 ° C. (g/cm$^3$) | 0.8348 |
| Cetane Number | 44.8 |
| Cetane Index | 50.6 |
| Olefins, FIA D1319-93 (% Vol.) | 3.2 |
| Aromatics, D1319-93 (% Vol.) | 24.5 |
| Sulfur, ASTM D2622 (ppm mass) | <0.7 |
| Carbon, ASTM D3343-95 (% mass) | 0.8659 |
| Distillation Properties, ASTM D86 | |
| IBP (° C.): | 181 |
| 10% (° C.): | 205 |
| 50% (° C.): | 259 |
| 90% (° C.): | 318 |
| End Point (° C.): | 351 |
| Residue Diesel (mL): | 0 |
| Recovery: | 100% |

Desulfation Strategy

Initial Desulfation Testing

Initial development performed using the dual path system was done without the use of the exhaust bypass valve. The desulfation routine was automated using a time-based schedule and the general procedure was as follows:

1. While the engine operated at mode 3 of the SET fuel was injected into the bypassed leg of the exhaust system creating a very rich environment ($\lambda<0.6$).

2. The bypass leg was then opened to full exhaust flow for a predetermined time. Oxidation of the hydrocarbon reductant over the CDPF and $NO_X$ adsorbers generated an exotherm causing an elevation in $NO_X$ adsorber temperature. The amount of fuel injected during the first event and the amount of time that the desulfating leg is exposed to full flow determined the temperature rise of the adsorber. If the adsorber reached the desulfation temperature, exhaust flow to the leg was closed off.

3. If the rear $NO_X$ adsorber catalyst did not reach the desired desulfation temperature, the process was repeated and the generated exotherm, in conjunction with convective heat transfer, brought both adsorber substrates to the target temperature.

4. Fuel was then injected into the leg to maintain the desired lambda value ($\lambda<1$) causing sulfur release. The low mass flow through the leg (caused by exhaust brake slip) allowed the adsorbers to stay at the desulfation temperatures for an extended period.

Refined Desulfation Testing

Further desulfation development performed using the dual path system was done with the use of an exhaust bypass valve to study the impact of exhaust flow. The test controller was automated to allow target lambda and exhaust bypass flows to be met. The desulfation leg lambda and exhaust bypass flow were optimized to allow exotherms to occur on the surface of the CDPF while minimizing exotherms on the $NO_X$ adsorber. The general procedure was as follows:

1. Target lambda, bypass flow, $NO_X$ adsorber temperature, and CDPF maximum temperature set points were inputted into the desulfation controller.

2. While the engine operated at mode 3 of the SET, fuel was injected into the bypassed leg of the exhaust system to meet the target exhaust lambda value. Bypass exhaust flowed into the desulfating leg at a low flow rate.

3. The combination of bypassed exhaust and injected fuel created exotherms from the oxidation of hydrocarbons on the surface of the CDPF causing an elevation in the CDPF temperature.

4. When the CDPF reached a predetermined temperature, the desulfation leg was opened to full exhaust flow. Heat was transferred convectively from the CDPF to the $NO_X$ adsorber. When the CDPF reached a preset lower temperature limit, the desulfating leg was switched back to bypass mode. This process was repeated until the $NO_X$ adsorbers reached the desired desulfation temperature.

5. When the desulfation temperature was reached, the bypass flow was lowered further and reductant was injected to maintain a desired lambda value causing sulfur release. Low mass flow through the leg allowed the adsorbers to stay at desulfation temperatures for an extended period.

Parametric testing was performed to determine the optimum parameters for heating the $NO_X$ adsorbers in preparation for desulfation. The goal was to reach desulfation temperature in the shortest amount of time, while keeping the adsorber temperature rise rate (i.e. exotherm) at a moderate level.

RESULTS

Initial Technique

The original heating/desulfation technique used an event timer table similar to that used in previous FTP tests an example of which appears below as Table X:

TABLE X

Heating/Desulfation Timer Table

| Event # | 1 | 2 | 3 | 4 | 5 | 6 |
|---|---|---|---|---|---|---|
| Time(s) | 0 | 85 | 115 | 250 | 270 | 850 |
| Flow path in bypass (0 or 1) | 0 | 1 | 0 | 1 | 0 | 0 |
| Fuel amount (lbs/min) | 0.25 | 0 | 0.25 | 0 | 0 | 0 |

This table commanded fueling rates, fueling durations and the flow control valves for the two exhaust legs. For heating and desulfurization, this table was set up to provide very rich ($\lambda<0.6$) conditions at low exhaust flows (from exhaust brake slip). Since the CDPF was lightly catalyzed and there was little oxygen present to oxidize all of the injected fuel, accumulation of fuel occurred on the adsorber substrates during the rich, low-flow condition. After about 85 seconds, the heating leg would be exposed to full exhaust flow. The accumulated fuel would then be oxidized producing a very rapid exotherm. The process was then repeated a second time to heat up the second $NO_X$ adsorber substrate (two 9.5" diameter ×6" long substrates were used). The $_{NOX}$ adsorber and CDPF temperatures can be seen in FIG. 4. The front adsorber bed temperature increased rapidly after the first exposure to full exhaust flow at 90 seconds. The exhaust flow was reduced again from 115 seconds to 250 seconds while running rich as indicated by Desulfation Lambda. When the leg was opened to full exhaust flow the second time, the second adsorber substrate saw a rapid increase in temperature. The $NO_X$ adsorbers reached their target temperature of 680° C. in about 270 seconds. The target temperature was defined for these tests to be the average of the $NO_X$ adsorber substrate temperatures.

Under these hot, rich conditions, sulfur was released in the form of $H_2S$. The sulfur release for this adsorber formula started at about 700° C. and progressed until the timer table stopped the fuel injection. The DOC downstream of the adsorbers operates in a lean environment that oxidizes the $H_2S$ to $SO_2$.

The drawback to this method of heating/desulfation is that the local surface temperatures seen during this exotherm must be well in excess of the measured temperatures in order to drive such a rapid increase in the adsorber substrate temperatures. Such high temperatures will damage known $NO_X$ adsorber washcoats. Since the local temperatures cannot be measured directly, the temperature change rate (TCR) has been adopted as an indicator of local surface temperatures and the general harshness of an exotherm with respect to the catalyst washcoat.

TABLE 4

Measurements made during five desulfation events using the initial technique described in the Results section.*

| Event | $t_R$ (s) | $T_R$ (° C.) | $M_R$ (ppm) | $t_{M_R}$ (s) | $t_{EoR}$ (s) | $T_{EoR}$ (° C.) | $\Delta M/\Delta t$ + (ppm/min) | $\Delta M/\Delta t$ − (ppm/min) |
|---|---|---|---|---|---|---|---|---|
| 1 | 358.3 | 701.0 | 416.7 | 519.5 | 852.9 | 645.0 | 124 | −60 |
| 2 | 349.6 | 701.6 | 190.7 | 543.5 | 863.4 | 625.9 | 47 | −29 |
| 3 | 347.9 | 701.8 | 152.2 | 552.2 | 858.4 | 633.8 | 36 | −24 |
| 4 | 352.5 | 701.3 | 109.0 | 583.2 | 859.4 | 631.5 | 23 | −19 |

TABLE 4-continued

Measurements made during five desulfation events using the initial technique described in the Results section.*

| Event | $t_R$ (s) | $T_R$ (° C.) | $M_R$ (ppm) | $t_{M_R}$ (s) | $t_{EoR}$ (s) | $T_{EoR}$ (° C.) | ΔM/Δt + (ppm/min) | ΔM/Δt − (ppm/min) |
|---|---|---|---|---|---|---|---|---|
| 5 | 348.7 | 701.6 | 77.2 | 594.2 | 861.0 | 628.9 | 15 | −14 |
| σ (% of mean) | 1.1 | 0.04 | 63 | 4.8 | 0.4 | 1.0 | 79.9 | 55.8 |

*The columns show, from left to right, attempt number, time to start of release, average NOx adsorber temperature at start of release, magnitude of peak release, time to peak release, time to end of release, and temperature at end of release. The last two columns present an approximation of the rate of release approaching and receding from peak release, respectively. The measured sulfur release was in the form of $H_2S$.

Using the above technique, measurements of desulfation parameters were taken for five separate, consecutive desulfation events with sufficient equilibration time between events. The measured parameters, shown in Table 4, include time to start of release, $t_R$ average $NO_X$ adsorber temperature at start of release, $T_R$ magnitude of peak release, $M_R$, time to peak release, $t_{MR}$ time to end of release, $t_{EOR}$, and temperature at end of release, $T_{EOR}$. Sulfur release data, from which $M_R$ was taken, was averaged over 10 seconds. The start of release is defined as the point at which release reaches 20% of $M_R$ during positive rate of release while the end of release is defined as the point at which release again reaches 20% of $M_R$ during negative rate of release. Using these definitions, sulfur removal at the start and end of release were determined to be well within the mass spectrometer measurement error of ±1% read value, down to 1 ppm. Approximations of the rate of release approaching ($\Delta M/\Delta t_+$) and receding from ($\Delta M/\Delta t$) the peak release were also included as parameters. The approaching and receding rates were approximated by $(t_{MR}-t_R)/(0.8*M_R)$ and $(t_{EoR}-t_{MR})/(-0.8*M_R)$, respectively. All five events were performed over the same CDPF and $NO_X$ adsorbers without re-poisoning the adsorbers between events. Since the amount of sulfur available for removal decreased after each event, this data allows the impact of sulfur load on the desulfation parameters listed in Table 4 to be determined.

For these five events, release of $H_2S$ occurred at an average time of 354 seconds with a deviation of approximately 1%, at a $T_R$ of 702° C. The deviation in $T_R$ is significantly less than the accuracy of the thermocouples used to measure its value. The general characteristics of sulfur removal suggested by $\Delta M(\Delta t_+$ and $\Delta M/\Delta t$ are a rapid increase in the amount of sulfur removed, from the start of release to the peak release, followed by a decrease in sulfur removal over a much longer time-scale. The average duration of release was 508 seconds with a deviation on the order of 1%. For each consecutive desulfation event, $M_R$ decreased by 20–54% while $t_{MR}$ increased by 2–5%, when compared to the previous event. It should be noted that although the parameters in Table 4 are dependant on $NO_X$ adsorber washcoat formulation, the above data may still be used to determine the qualitative dependence of these parameters on sulfur load for any washcoat with generally similar characteristics to those that have been used here.

The relationship between TCR and catalyst durability has not been firmly established and is washcoat and substrate dependent. The TCRs that result from the heating algorithm described above are likely to be damaging to the washcoats, particularly the adsorbers. The CDPF has a simpler washcoat formulation that is designed to be tolerant of the exotherms that occur when accumulated PM rapidly oxidizes. Thus CDPFs are less likely to be damaged by fuel-induced exotherms than $NO_X$ adsorbers. Considering these factors, another heating algorithm was investigated.

Refined Heating Technique

The next heating algorithm attempted to minimize the adsorber exotherm by oxidizing most of the fuel on a highly catalyzed DPF. The lambda values were also kept at 0.8 or higher to minimize the fuel slippage through the CDPF.

In addition to very high TCRs, the previous timer table method suffered from repeatability issues. The exotherm behavior of the catalysts is dependent on their conditioning prior to the start of test. Although substrate temperature repeatability was shown in five consecutive tests, the maximum temperatures and lambdas varied from day to day with the same timer table. To address this, the controller was modified in three ways. The first modification was the addition of a routine that monitored the catalyst temperatures. This routine looked at preset maximum temperatures for the CDPF, shutting off the fuel and opening the desulfating leg to full flow when the CDPF temperature reached the set maximum, allowing for convective heat transfer to the $NO_X$ adsorbers. The adsorber temperatures were also monitored to determine when they had reached the desired temperature. When this happened the controller transitioned from the healing phase to the desulfurization phase. During this phase the exhaust flow was lowered to minimize the exotherm caused by the fuel injected to maintain $\lambda<1$. The elevated temperature and the lambda conditions were then held in these desulfation-promoting conditions.

The other two modifications were the addition of closed loop lambda control based on feedback from an oxygen sensor and closed loop control of the exhaust bypass flow based on feedback from a sharp edged orifice. The hardware changes are described in the Exhaust System Description.

Experimental data indicates that about two-thirds of the sulfur comes off of the front substrate. This would be expected since the front substrate should capture most of the sulfur. The data also dispels the concern that sulfur released from the front substrate gets readsorbed on the rear substrate. This may still be happening to some degree, but the data indicates a net sulfur release from the second substrate. The release shown here is smaller in magnitude than in FIG. 4 due to the frequent desulfurizations that had occurred prior to this data set.

This refined method produced maximum TCRs for all of the catalysts which were substantially lower than those of the initial heating technique which indicates that the exotherm has been substantially moved to the CDPF. The exotherm on the CDPF is controlled by higher lambdas during heating and temperature modulation by the controller. The combination of these parameters minimizes fuel slippage to the adsorbers and lowers the CDPF exotherm when exposed to full flow.

Desulfation Parametric Study

After refining the desulfation heating technique it was decided to run a parametric study to determine which variables affected $NO_X$ adsorber temperature rise. A ($2^4$) Two-Level Factorial Design of Experiments was employed to determine which variables had a significant effect on temperature rise over the CDPF and $NO_X$ adsorbers.

The variables studied were Exhaust Bypass Flow, Exhaust Lambda, CDPF Hysteresis, and the CDPF Maximum Temperature. Exhaust Bypass Flow was the amount of exhaust flowing into the desulfating leg of the exhaust via the bypass pathway. Exhaust Lambda was measured downstream of the rear $NO_X$ adsorber. CDPF Temperature was used to trigger convective heat transfer from the CDPF to the $NO_X$ adsorber. CDPF Hysteresis is defined as the temperature difference between the Maximum CDPF temperature that initiated convective heat transfer to the $NO_X$ adsorbers and the minimum CDPF temperature that triggers the end of the heat transfer event. There were six response variables that are thought to characterize the heating of the $NO_X$ adsorbers. The responses that were investigated were the TCR of the front $NO_X$, adsorber substrate, TCR Front Adsorber (° C./Sample); the TCR of the rear adsorber substrate, TCR Rear Adsorber (° C./Sample); the average difference in the NO, adsorber substrate temperatures over the test cycle, Average Adsorber Temperature Difference (° C.); TCR of the CDPF to the maximum temperature set point, TCR to CDPF Maximum Temperature (° C./Sample); the time it took the average $NO_X$ adsorber temperature to reach the desired level, Time to Average Adsorber Temperature (s); and the final adsorber temperature difference, Front/Rear Final Adsorber Temperature Difference (° C.).

A test matrix of 16 tests was generated and each test was run twice for a total of 32 tests. Table 5 shows the results of the test matrix. The effects of the four main variables were calculated, as well as the first order interactions. To test for significance the effects were compared to the 95% confidence interval of the mean for each response variable.

TABLE 5

Results of desulfation parametric study.

| | TCR Front Adsorber (° C./sample) | TCR Rear Adsorber (° C./sample) | Average Adsorber Temperature Difference (° C.) | TCR to CDPF Maximum Temperature (° C./sample) | Time to Average Adsorber Temperature (s) | Front/Rear Adsorber Final Temperature Difference (° C.) |
|---|---|---|---|---|---|---|
| Exhaust Bypass Flow Effects | 0.4 | 0.4 | 30.8 | −1.1 | −152 | −34 |
| Lambda Effects | −0.4 | 0.3 | −22.9 | 0.1 | 40 | −8 |
| Effect of CDPF Hysteresis | 0.5 | 0.1 | −11.2 | 0.3 | 22 | −28 |
| Effect of CDPF Max | −0.7 | −0.1 | 12.6 | 0.1 | −16 | 39 |
| Effect of X1X2 | −0.4 | 0.3 | −10.7 | 0.4 | 33 | 8 |
| Effect of X1X3 | 0.3 | 0 | −0.8 | 0 | 30 | −4 |
| Effect of X1X4 | 0.1 | −0.1 | 7.4 | −0.1 | −24 | 30 |
| Effect of X2X3 | −0.1 | 0.1 | 18.8 | −0.3 | 12 | −39 |
| Effect of X2X4 | 0.4 | 0 | −1.5 | 0.1 | −18 | 33 |
| Effect of X3X4 | −0.4 | 0 | 4.1 | 0.2 | −16 | −3 |
| 95% Conf Interval | 0.4 | 0.2 | 14.4 | 0.3 | 49 | 26 |

Table 5 shows that the exhaust bypass flow is significant in five of the six response variables. The exhaust Lambda shows a weaker significance in three of the six response variables. The CDPF hysteresis and CDPF maximum temperature variables show a much weaker significance than the bypass flow and lambda. The confounded effects, which show significance, are believed to be artifacts of the multiple tests because they do not show significance when each set of runs is looked at separately.

CONCLUSION

This sequence of tests has shown that exotherms can be created across the catalysts in a way that minimizes sintering of the washcoats. Temperature change rate (TCR) was used as a measure of sintering potential. The multiple-leg arrangement allows independent control of the exhaust flow and lambda, which are the key parameters controlling the heat released by the oxidation of diesel fuel on the CDPF. The tests have shown that desulfurization temperatures can be repeatably reached using this controlled oxidation.

Sulfur was released in these tests as $H_2S$. Since the system has a cleanup DOC operating continuously in a lean oxidizing environment, the $H_2S$ should be oxidized to $SO_2$. This remains to be verified. Dual sampling of the $H_2S$ has revealed a net sulfur release on the front and rear adsorbers rather than a simple transfer of sulfur from the front adsorber to the rear.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. A method of treating exhaust gas stream which is in a lean state, fuel-lean of stoichiometric, and contains $NO_X$ and $SO_2$, said method comprising:

a) splitting the exhaust gas stream into major and minor exhaust gas portions for flow through at least first and second separate flow paths, each of the flow paths containing a particulate trap and, downstream of the particulate trap, a $NO_X$ absorber containing a $NO_X$ oxidation catalyst and a nitrate adsorbent;

b) passing the major exhaust gas portion in the lean state and at a first temperature, for a first period of operation, along at least one of said flow paths and through, in succession, the particulate trap and the $NO_X$ absorber to convert the $NO_X$ to nitrate, to convert the $SO_2$ to sulfate, and to adsorb the nitrate and sulfate on the nitrate adsorbent;

c) monitoring temperatures in the particulate trap and in the $NO_X$ adsorber;

d) after the first period of operation, switching the flows of the exhaust gas portions so that the one flow path receives the minor exhaust gas portion for a second period of time;

e) during at least a portion of the second period of time, introducing fuel into the one flow path, upstream of the particulate trap, for combustion in the particulate trap, thereby producing a fuel-rich, reducing exhaust flow;

f) during said second period of operation, diverting a bypass portion of exhaust from the other flow path at point upstream of the particulate trap and introducing the bypass portion into the one flow path upstream of the particulate trap;

g) responsive to the temperature of the particulate trap in the one flow path reaching a first predetermined temperature, discontinuing feed of fuel to the particulate trap in the one flow path and increasing flow of exhaust gas through the one flow path to transfer heat from the particulate trap to the $NO_X$ adsorber to raise the temperature of the $NO_X$ adsorber to a second predetermined temperature for desulfation; and h) periodically switching the major and minor exhaust gas portions between flow paths so that second period operation is effected in a flow path while first period operation is effected in at least one other flow path.

2. The method of claim 1 wherein the second predetermined temperature is 500–750° C.

3. The method of claim 1 wherein the particulate trap is a catalyzed diesel particulate filter.

4. The method of claim 1 wherein the minor exhaust gas portion is 5% or less of the exhaust gas stream.

5. The method of claim 1 further comprising combining the major and minor exhaust gas portions downstream of the $NO_X$ absorbers.

6. The method of claim 5 further comprising passing the combined exhaust gas portions through a diesel oxidation catalyst.

7. The method of claim 1 further comprising passing the exhaust gas portions through a diesel oxidation catalyst.

8. The method of claim 1 further comprising determining at least one of engine speed and engine load and setting an amount of fuel introduced and bypass flow during the second period of time in accordance with the determined engine speed and/or engine load.

9. The method of claim 1 wherein steps e, f and g are repeated as necessary to bring the $NO_X$ adsorber to the second predetermined temperature.

10. The method of claim 1 further comprising:

sensing $NO_X$ concentration exiting each $NO_X$ adsorber;

responsive to the sensed $NO_X$ concentration exceeding a predetermined value, switching the flows of exhaust gas portions so that a flow path to be subjected to denitration receives the minor exhaust gas portion;

introducing fuel into the minor exhaust gas portion to create a reducing atmosphere for reduction of nitrates adsorbed on the nitrate adsorbent to form molecular nitrogen gas.

11. The method of claim 1 further comprising:

upon reaching the second predetermined temperature for sulfation in step g, introducing additional fuel and a bypass portion of the exhaust gas from another flow path at a point upstream of the particulate trap to again produce a fuel rich atmosphere for desulfation.

12. An apparatus for treating an exhaust gas stream which is in a lean state, fuel-lean of stoichiometric, and containing $NO_X$ and $SO_2$, said apparatus comprising:

an engine speed sensor;

means for determining engine load;

plural exhaust flow conduits for respectively receiving portions of exhaust gas from an internal combustion engine;

in each of the exhaust conduits, a particulate trap, and downstream of the particulate trap, a $NO_X$ adsorber containing a $NO_X$ oxidation catalyst and a nitrate adsorbent;

temperature sensors for monitoring temperatures of the particulate traps and $NO_X$ adsorbers;

a bypass line for connecting each exhaust flow conduit with at least one other exhaust flow conduit, the bypass line connecting the exhaust flow conduits at points upstream of the particulate traps;

a regulating valve in the bypass line;

a fuel injector associated with each of the exhaust flow conduits for injecting fuel upstream of its particulate trap; and a controller for controlling said regulating valve and said fuel injector responsive to signals from said temperature sensors, said engine speed sensor and the determined engine load.

* * * * *